US005619105A

United States Patent [19]

Holmquest

[11] Patent Number: 5,619,105

[45] Date of Patent: Apr. 8, 1997

[54] ARC DETECTION AND CUT-OUT CIRCUIT

[75] Inventor: John C. Holmquest, El Paso, Tex.

[73] Assignee: Valmont Industries, Inc., Valley, Nebr.

[21] Appl. No.: 516,051

[22] Filed: Aug. 17, 1995

[51] Int. Cl.[6] ..... H05B 37/02

[52] U.S. Cl. ..... 315/225; 315/119; 315/125; 315/DIG. 5; 315/DIG. 7

[58] Field of Search ..... 315/225, 119, 315/125, 194, 307, DIG. 5, DIG. 7

[56] References Cited

U.S. PATENT DOCUMENTS

| | | | |
|---|---|---|---|
| Re. 32,904 | 4/1989 | Pacholok | 363/131 |
| 4,503,363 | 3/1985 | Nilssen | 315/225 |
| 4,939,427 | 7/1990 | Nilssen | 315/209 |
| 5,142,202 | 8/1992 | Sun et al. | 315/225 |
| 5,179,490 | 1/1993 | Lawrence | 361/42 |
| 5,280,404 | 1/1994 | Ragsdale | 361/113 |
| 5,291,099 | 3/1994 | Gill et al. | 315/119 |

*Primary Examiner*—Georgia Y. Epps
*Assistant Examiner*—Reginald A. Ratliff
*Attorney, Agent, or Firm*—Zarley, McKee, Thomte, Voorhees, & Sease

[57] ABSTRACT

An arc detection and cut-out circuit is connected to an electronic ballast to detect when arcing occurs and to disable the ballast when arcing occurs. The arc detection and cut-out circuit is comprised of a current detector and a shunt circuit. The current detector detects the current in the electronic ballast to determine if arcing has occurred. If detected, the current detector causes a shunt circuit to shunt the power inverter of the ballast shutting it down. The arc detection and cut-out circuit prevents the power inverter from starting up until the power to the ballast is cycled off and back on.

26 Claims, 2 Drawing Sheets

ARC DETECTION AND CUT-OUT CIRCUIT

BACKGROUND OF THE INVENTION

1. Field of the Invention

The present invention relates to circuits for driving gas discharge lighting circuits. More particularly, the present invention relates to a protection circuit for an electronic ballast or other power supply circuit that detects an arc somewhere in the system and shuts down the ballast.

2. Problems in the Art

A potential fire hazard exists when arcing occurs in an electronic circuit. This hazard is much greater when high frequency electronic ballasts are used. Arcing is usually caused by poor connections in the wiring of fluorescent lamps or other discharge lamps that have high open circuit voltages. Arcing can occur at any poor connection where an effective air gap is created such as at the lamp socket or at an in-line connector. If there is an air gap, arcing will occur if the lamp voltage and current are high enough. Typically, in a line frequency fluorescent lamp circuit, an arc will extinguish itself as the alternating current passes through the zero axis. However, in a high frequency electronic ballast lamp circuit, the arc can be maintained through the current zero crossing if there is not sufficient de-ionization time for the arc to extinguish during the current zero axis crossing. The energy in an arc causes a rise in temperature and a potential out-gassing and combustion of adjacent flammable materials. This may result in burned lamp sockets or connectors.

The heat energy resulting from an arc of a typical constant current high frequency electronic ballast will equal the lamp current times the voltage drop across the arc. As a result, a large number of watts can be generated in a confined arc within a plastic connector or lamp socket. This large number of watts results in very high temperatures within the plastic connector or lamp socket. Unless the arc extinguishes itself, the high temperature created at the electrodes of the arc can cause the combustion of flammable adjacent material such as the plastic housing or electrical connector.

There are several prior art systems used to detect abnormal conditions in a circuit. For example, one prior system uses a current sensor along with a square wave generator and a counter to detect an arc across a break in a line. Other systems use various means to detect problems in a circuit such as a load failure condition, or a ground fault condition. These systems typically are complex and have a limited usefulness.

Therefore, a need can be seen for a system to eliminate the creation of high temperatures by an arc. Such a system would detect an arc in the circuit, latch the power supply off before high temperatures can develop across the arc, and force the circuit to remain off as long as desired. It is also desirable to provide a protection circuit that is simple, efficient, and works with most power supply circuits.

OBJECTS OF THE INVENTION

A general object of the present invention is the provision of an arc detection and cut-out circuit.

A further object of the present invention is the provision of an arc detection and cut-out circuit for a power supply circuit that detects the presence of an arc and shuts down the power supply circuit as a result.

A further object of the present invention is the provision of an arc detection and cut-out circuit for a power supply circuit that detects arcing by magnetically detecting the output current of the power supply.

A further object of the present invention is the provision of an arc detection and cut-out circuit that uses a shunt circuit to disable the power supply circuit when an arc is detected.

A further object of the present invention is the provision of an arc detection and cut-out circuit that prevents a power inverter circuit from restarting after an arc is detected.

A further object of the present invention is the provision of an arc detection and cut-out circuit that uses a switching device such as a thyristor to enable a shunt circuit to operate when an arc is detected.

A further object of the present invention is the provision of an arc detection and cut-out circuit that detects the output current of a power supply circuit through a lamp lead to determine the presence of arcing.

These as well as other objects of the present invention will become apparent from the following specification and claims.

SUMMARY OF THE INVENTION

The arc detection and cut-out circuit of the present invention uses a current detector to detect the current in an electronic ballast or other power supply to determine whether arcing has occurred. If the detected current is characteristic of the current resulting from an arc, the cut-out circuit will shunt a portion of the power inverter of the electronic ballast to prevent the power inverter from oscillating. The arc detection and cut-out circuit can also be designed to maintain a shunt circuit even after the arc extinguishes. The circuit also shunts the power inverter start-up circuit to prevent the ballast circuit from restarting.

DETAILED DESCRIPTION OF THE PREFERRED EMBODIMENT

The present invention will be described as it applies to its preferred embodiment. It is not intended that the present invention be limited to the described embodiment. It is intended that the invention cover all alternatives, modifications, and equivalences which may be included within the spirit and scope of the invention.

Figure 1:
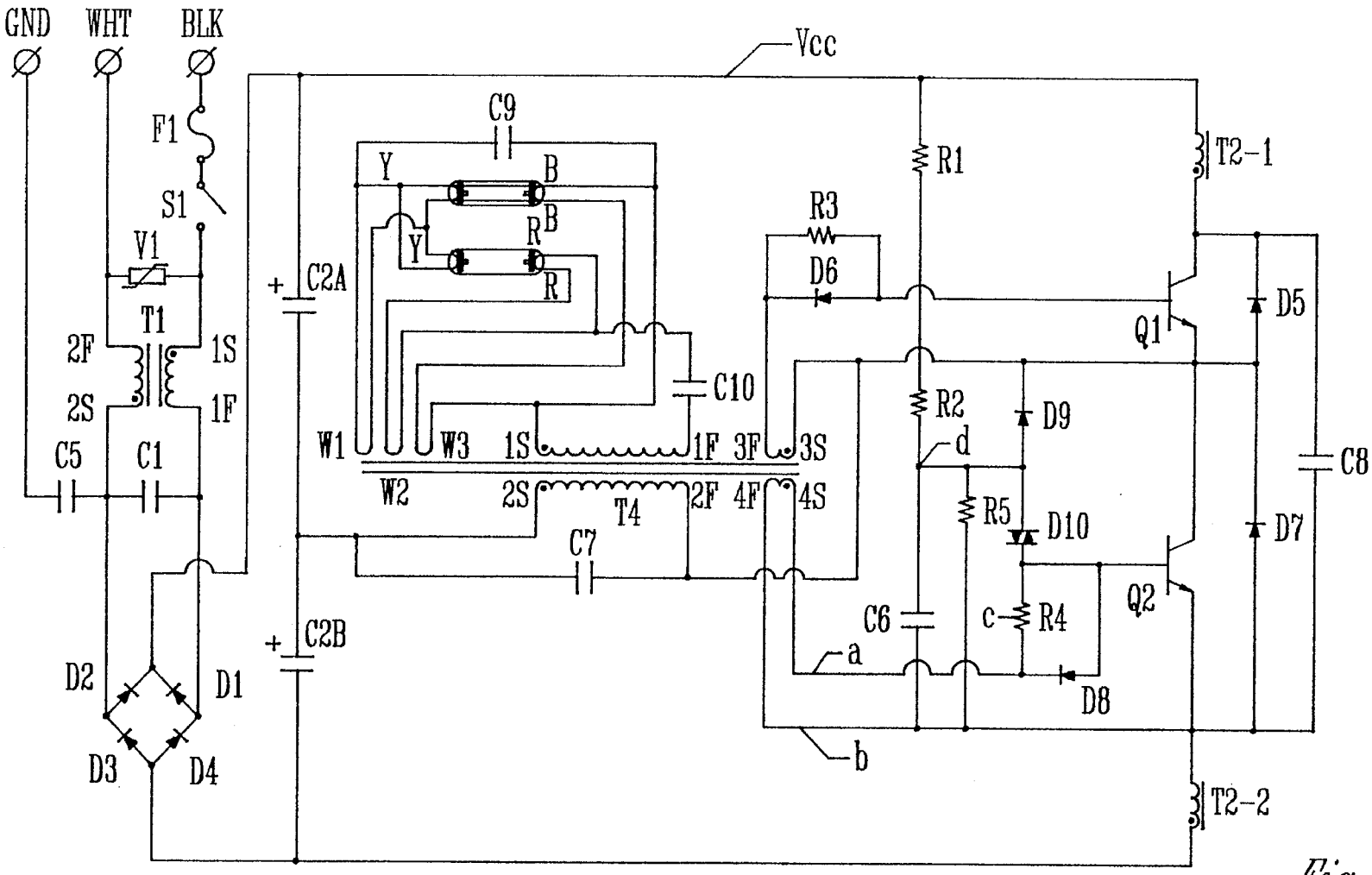
FIG. 1 shows a schematic circuit diagram of an electronic ballast circuit.

FIG. 1 is one example of a power supply circuit which could be used with the arc detection and cut-out circuit of the present invention. The circuit shown in FIG. 1 is a an electronic ballast circuit for driving two rapid start fluorescent lamps. The circuit shown in FIG. 1 can be divided into three functional blocks, an input stage, a power inverter stage and an output stage.

The input stage is comprised of a harmonic suppression, electromagnetic interference (EMI), and transient suppression filter and a bridge rectifier. The input stage in connected to a power source at the connections shown as GND, WHT, and BLK in FIG. 1. One purpose of the input filter is to prevent the possible radiation of radio frequency (RF) interference from the input power line as well as filtering out incoming interference that may be present on the power line. The input filter is comprised of varistor V1, transformer T1, and capacitors C1 and C5 as shown in FIG. 1.

The input filter is connected to the bridge rectifier which is comprised of rectifying diodes D1–D4 and storage capacitors C2A and C2B. The purpose of the rectifier is to rectify the AC input voltage.

The rectifier is connected to the power inverter stage. In the example shown in FIG. 1, the power inverter is a half bridge type of circuit having two power switching devices (shown as transistors Q1 and Q2 in FIG. 1) connected in a half bridge configuration. Other types of switching devices could also be used. Transistors Q1 and Q2 are driven by the voltages developed across the secondary windings (3F/3S and 4F/4S respectively) of transformer T4. The power inverter is connected to the output stage which is comprised of a load transformer T4 and two rapid start fluorescent lamps.

One novel feature of the output stage of the circuit shown in FIG. 1 is the configuration of the lamp filament windings W1, W2, and W3. The filament windings are single windings wound around transformer T4. Other ballast circuits require an additional transformer. The configuration of filament windings W1, W2, and W3 reduces the number of components required which reduces the cost and increases the reliability of the circuit.

Figure 2:
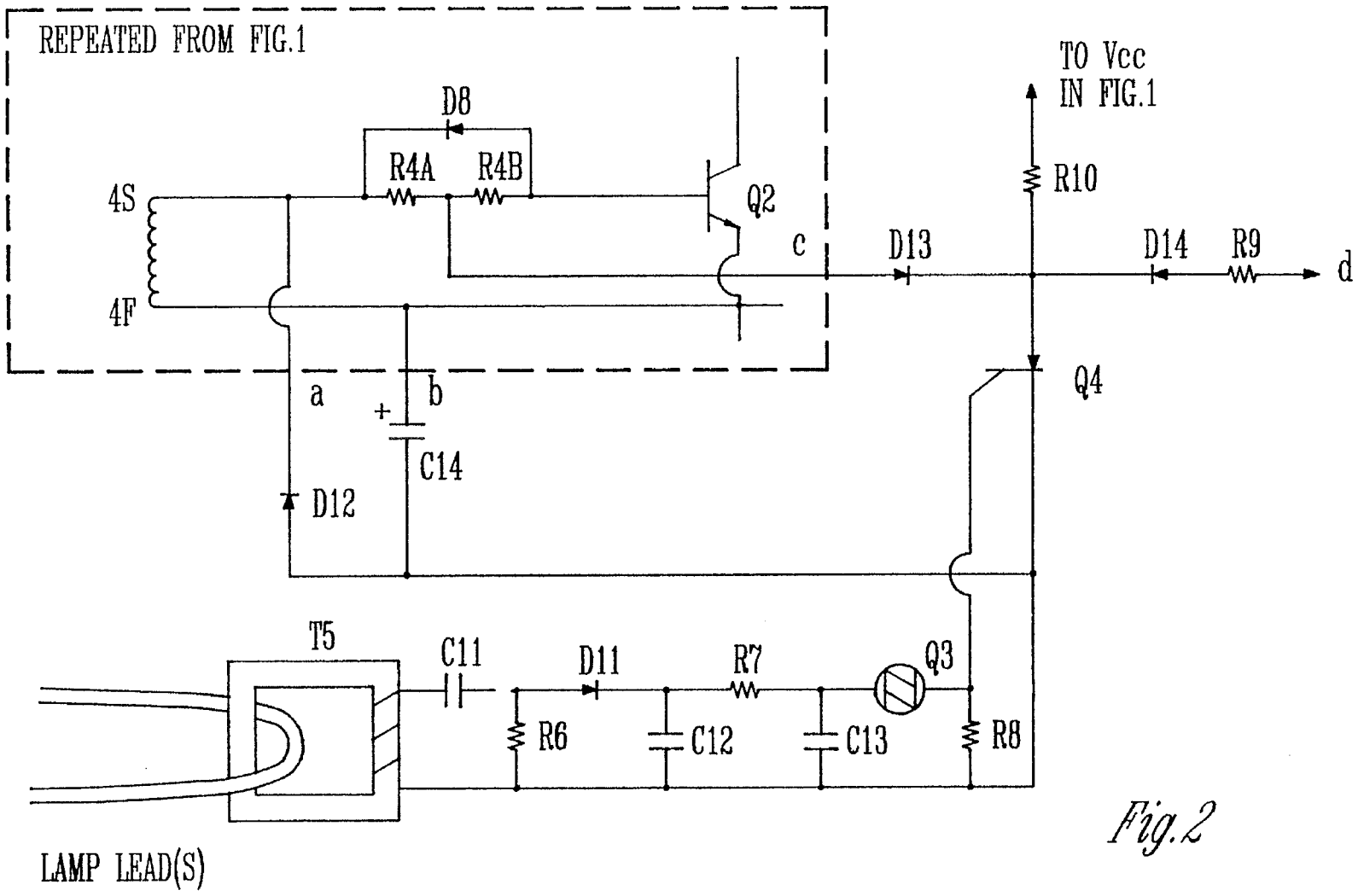
FIG. 2 shows a schematic circuit diagram of the arc detection and cut-out circuit of the present invention and how it connects to the electronic ballast circuit shown in FIG. 1.

FIG. 2 is a schematic diagram of an embodiment of the arc detection and cut-out circuit of the present invention. The arc detection and cut-out circuit will work with most electronic ballasts or power supply circuits, including the example shown in FIG. 1.

As shown in FIG. 2, the arc detection circuit connects to the ballast circuit shown in FIG. 1 at the points a, b, c, and d shown in the figures. The arc detection circuit is also operatively coupled to the ballast circuit at a point where the output current can be detected.

The detection of an arc is accomplished in the preferred embodiment by magnetically detecting the output current from the ballast circuit. As shown in FIG. 2, the circuit includes a small toroid T5. One or more lamp leads are passed through or wound around the toroid T5 to detect the current through the lamp leads. Both red lamp leads or both blue lamp leads could be used or a single lamp lead in series with 1S or 1f of transformer T4 (FIG. 1) could be used to detect the output current. Similarly, if the present invention is used with an instant start parallel or series start lamp circuit, a single lead could be used to detect the output current. As an alternative to the toroid T5, arc detection could be accomplished by using an additional winding closely coupled to the ballast output winding (T4) to magnetically detect the output current from the ballast.

A winding is wound around the toroid and is connected to a high pass filter comprised of capacitor C11 and resistor R6. The high pass filter attenuates the normal high frequency lamp current signal detected at toroid T5 (typically 20–80 KHz), but passes across resistor R6 any high voltage radio frequency (RF) signals. RF signals can be created various ways, including when arcing occurs in the electronic ballast. In other words, only the high frequency RF signals resulting from arcing will pass through the high pass filter.

The RF signal (from arcing) passing through the high pass filter across R6 is rectified by diode D11 and charges capacitor C12. Capacitor C13 is charged by the voltage across C12 but is delayed by resistor R7 and capacitor C13. The time delay is relatively small (several milliseconds) and is determined by the RC time constant of resistor R7 and capacitor C13. As a result, the time delay is directly proportional to the amount of power in the arc. The primary purpose of the time delay is to prevent nuisance RF energy from causing the cut-out circuit to disable the power supply circuit. Nuisance RF energy could come from various sources such as RF energy generated from the lamps, adjacent circuitry, etc.

Connected to the resistor R7 and capacitor C13 is a threshold detector breakover device Q3. In the preferred embodiment, the breakover device Q3 is comprised of a bilateral switch having a threshold level of about 9 volts. When the voltage across capacitor C13 reaches the threshold level of the breakover device Q3, the breakover device Q3 will effectively become a short circuit. The breakover device Q3 is connected to the gate terminal of thyristor Q4. When the voltage across capacitor C13 reaches the threshold level of breakover device Q3, the voltage will be applied to the gate of thyristor Q4 providing the turn-on power to thyristor Q4.

When arcing occurs and thyristor Q4 is turned on, the power inverter circuit shown in FIG. 1 is cut-out by reverse biasing the base to emitter junction of transistor Q2. This is accomplished by shunting the drive voltage provided to transistor Q2. The voltage that normally drives transistor Q2 is provided by winding 4S through resistor R4 to the base of transistor Q2. When thyristor Q4 is turned on, the drive voltage to the base of transistor Q2 is shunted from 4S through resistor R4A, diode D13, thyristor Q4, and capacitor C14. In other words, the drive voltage provided to the base of transistor Q2 during normal operation of the ballast circuit is reduced by turning on thyristor Q4 which provides a path for the voltage to bypass transistor Q2.

The power inverter can not be cut-out cleanly and rapidly without reverse biasing transistor Q2. Transistor Q2 is reverse biased using diode D12 and capacitor C14. Under normal operation of the ballast, C14 will be charged up in the direction shown in FIG. 2 because D12 will rectify the voltage across 4S and 4F. Immediately when thyristor Q4 turns on, it completes a path through diode D13, resistor R4A, 4S, 4F, and capacitor C14. The voltage across capacitor C14 has already been charged to approximately 6–7 volts (in the preferred embodiment). After thyristor Q4 turns on, a reverse voltage is applied to the base to emitter of transistor Q2 ensuring its rapid shut down.

The arc detection and cut-off circuit also prevents the ballast circuit from starting up again. When the power inverter is not oscillating and thyristor Q4 is conducting, the inverter start-up circuit is disabled. Under normal operation of the ballast circuit in FIG. 1, when power is initially provided to the circuit, transistors Q1 and Q2 will oscillate after the start-up circuit starts the oscillations. The ballast start-up circuit is comprised of resistors R1 and R2, capacitor C6, diode D9, and diac D10. When a voltage is provided to Vcc, Vcc will charge up capacitor C6 by providing current through resistors R1 and R2, and transformer T2-2. The time constant is such that capacitor C6 will charge up within about the first half cycle. When the voltage across capacitor C6 reaches the breakover voltage of diac D10 (approximately 32 volts in the preferred embodiment), diac D10 will conduct and discharge capacitor C6. As a result, a drive voltage is provided to the base of transistor Q2 which turns it on and initiates the oscillating power inverter. Diode D9 will prevent capacitor C6 from charging up again. The start-up circuit is disabled by shunting capacitor C6 in FIG.

1. When thyristor Q4 is turned on, it provides a path from the point labeled "d" in FIG. 1 through resistor R9, diode D14, and thyristor Q4 (FIG. 2), shunting capacitor C6 and the start-up circuit. Capacitor C6 is therefore held below the breakover voltage of diac D10 preventing the oscillating power inverter from starting up.

Thyristor Q4 will remain turned on in the conducting state by the holding current provided by Vcc through resistor R10 (FIG. 2). As long as Vcc (the rectified input voltage) remains high, resistor R10 will provide a small bleed current through thyristor Q4 which is more than the holding current of thyristor Q4. Therefore, thyristor Q4 will remain turned on and will conduct current. Vcc will remain high as long as AC power is provided to connections WHT and BLK of the electronic ballast. Therefore, the power inverting circuit in FIG. 1 will remain latched off as long as the input power is provided to the ballast circuit. When the input power is removed by opening switch S1 or otherwise removing the input power, Vcc will decay until the current falls below the holding current of thyristor Q4, thereby turning it off. Once thyristor Q4 is turned off, the arc detection and cut-out circuit shown in FIG. 2 is inactive so that the electronic ballast shown in FIG. 1 is free to operate normally once input power is provided by closing switch S1.

Table 1 includes values for the components of the preferred embodiment. While these are the values of the preferred embodiment, it will be understood that the invention is not limited to these values.

The preferred embodiment of the present invention has been set forth in the drawings and specification, and although specific terms are employed, these are used in a generic or descriptive sense only and are not used for purposes of limitation. Changes in the form and proportion of parts as well as in the substitution of equivalents are contemplated as circumstances may suggest or render expedient without departing from the spirit and scope of the invention as further defined in the following claims.

TABLE 1

| ITEM | DESCRIPTION | VALUE or PART NUMBER |
|---|---|---|
| R1 | Resistor | 180 KOhms |
| R2 | Resistor | 180 KOmhs |
| R3 | Resistor | 15 Ohms |
| R4 | Resistor | 15 Ohms |
| R4A | Resistor | 10 Ohms |
| R4B | Resistor | 5.1 Ohms |
| R5 | Resistor | 200 KOhms |
| R6 | Resistor | 3.3 KOhms |
| R7 | Resistor | 47 KOhms |
| R8 | Resistor | 1 KOhms |
| R9 | Resistor | 2.2 KOhms |
| R10 | Resistor | 10 KOhms |
| C1 | Capacitor | 4.7 μF |
| C2A | Capacitor | 330 μF |
| C2B | Capacitor | 330 μF |
| C5 | Capacitor | 4700 pF |
| C6 | Capacitor | 0.1 μF |
| C7 | Capacitor | 0.1 μF |
| C8 | Capacitor | .015 μF |
| C9 | Capacitor | 270 pF |
| C10 | Capacitor | .0053 μF |
| C11 | Capacitor | 360 pF |
| C12 | Capacitor | 0.22 μF |
| C13 | Capacitor | 0.1 μF |
| C14 | Capacitor | 100 μF |
| D1 | Diode | 2 amp/600 v |
| D2 | Diode | 2 amp/600 v |
| D3 | Diode | 2 amp/600 v |
| D4 | Diode | 2 amp/600 v |
| D5 | Diode | 1 amp/1000 v |

TABLE 1-continued

| ITEM | DESCRIPTION | VALUE or PART NUMBER |
|---|---|---|
| D6 | Diode | 1 amp/40 v |
| D7 | Diode | 1 amp/1000 v |
| D8 | Diode | 1 Amp/40 v |
| D9 | Diode | 1 amp/1000 v |
| D10 | Diac | 32 volt |
| D11 | Diode | 1N4148 |
| D12 | Diode | 1 a/40 v |
| D13 | Diode | 1N4007GP |
| D14 | Diode | 1N4007GP |
| Q1 | Transistor | 2SC4055 |
| Q2 | Transistor | 2SC4055 |
| Q3 | Bilateral Switch | MBS4993 |
| Q4 | Thyristor | TCR22-6 |
| V1 | Varistor | 150 $V_{RMS}$ |

What is claimed is:

1. An arc detection and cut-out circuit for protecting an electronic ballast having an oscillating power inverter with at least one switching device and a startup circuit to initiate the oscillation of the oscillating power inverter, said circuit comprising:

a current detector electrically coupled to said ballast for detecting a current in said ballast;

a first shunt circuit operatively coupled to said current detector for shunting a portion of said power inverter to prevent said power inverter from oscillating when said current detector detects a current having certain characteristics; and a second shunt circuit coupled to said current detector for shunting the start-up circuit when said current detector detects a current having certain characteristics.

2. The arc detection and cut-out circuit of claim 1 wherein said current detector detects the current through at least one lamp lead of said electronic ballast.

3. The arc detection and cut-out circuit of claim 1 wherein said current detector is comprised of a toroid, said toroid being magnetically coupled to said ballast.

4. The arc detection and cut-out circuit of claim 1 wherein said first shunt circuit is adapted to shunt said switching device when said current detector detects a current having certain characteristics.

5. The arc detection and cut-out circuit of claim 1 further comprising:

a second switching device operatively coupled to said current detector and operatively connected to said second shunt circuit such that said current detector controls said second switching device which in turn controls said second shunt circuit; and a path between a power supply and said second switching device for maintaining said second shunt circuit as long as said path is present between said power supply and said second switching device.

6. The arc detection and cut-out circuit of claim 5 wherein said second switching device is disabled when said power supply is disabled.

7. The arc detection and cut-out circuit of claim 4 further comprising:

a second switching device operatively coupled to said current detector and operatively connected to said first shunt circuit such that said current detector controls said second switching device which in turn controls said first shunt circuit.

8. The arc detection and cut-out circuit of claim 7 wherein said second switching device is comprised of a thyristor.

9. The arc detection and cut-out circuit of claim 7 further comprising a threshold detector operatively coupled to said current detector and said second switching device for actuating said second switching device when the output of said current detector reaches a certain threshold.

10. The arc detection and cut-out circuit of claim 1 wherein said current detector further comprises a delay circuit for delaying the output of said current detector such that the first shunt circuit does not shunt said power inverter when said current detector detects a current resulting from certain spurious signals.

11. The arc detection and cut-out circuit of claim 10 wherein the length of the delay caused by said delay circuit is proportional to the power of the current detected by said current detector.

12. The arc detection and cut-out circuit of claim 1 further comprising a high pass filter operatively connected to said current detector for attenuating detected currents resulting from the normal operation of said electronic ballast.

13. An electronic circuit for protecting a power supply circuit having a power inverter with at least one switching device, said circuit comprising:

a current detector electrically coupled to said power supply circuit for detecting a current in said power supply circuit;

a filter network connected to said current detector for discriminating between current resulting from the normal operation of the power supply circuit and current resulting from arcing;

a control circuit connected to said filter network; a shunt circuit connected to said power inverter and operatively connected to said control circuit; and wherein said control circuit causes said shunt circuit to shunt said switching device of said power inverter when current resulting from arcing is detected.

14. The electronic circuit of claim 13 wherein said filter network includes a high pass filter for attenuating detected current resulting from the normal operation of the power supply circuit.

15. The electronic circuit of claim 14 wherein said filter network additionally includes a delay for delaying said detected current.

16. The electronic circuit of claim 15 wherein said delay has an RC time constant which is proportional to the power in the detected current.

17. The electronic circuit of claim 13 wherein said control circuit includes a control circuit switching device.

18. The electronic circuit of claim 17 wherein said control circuit switching device is comprised of a thyristor.

19. The electronic circuit of claim 17 wherein said control circuit includes a breakover device connected between said control circuit switching device and said filter network such that said breakover device causes said control circuit switching device to actuate when the output of the filter network reaches a certain threshold level.

20. The electronic circuit of claim 13 wherein said power inverter includes a start-up circuit, said electronic circuit further comprising a second shunt circuit operatively connected to said control circuit for shunting said start-up circuit when arcing is detected.

21. A method of protecting an electronic ballast circuit having a power inverter comprising the steps of:

detecting the output current of said electronic ballast circuit;

discriminating between the current detected and the normal output current to determine if arcing has occurred; and shunting a portion of the power inverter when arcing has occurred to disable the electronic ballast circuit.

22. An electronic circuit for driving a lamp load comprising:

an input stage for receiving an AC input voltage supply;

a rectifier stage coupled to said input stage;

a power inverter coupled to said rectifier stage;

a load transformer having a load transformer core, said load transformer coupled to said power inverter;

a lamp load coupled to said load transformer for supplying power to said lamp load, said lamp load including a plurality of lamps each of said lamps having at least one lamp filament winding; and wherein each of said lamp filament windings are wound around said load transformer core.

23. An arc detection and cut-out circuit for protecting an electronic ballast having a power inverter with at least one switching device, said circuit comprising:

a current detector electrically coupled to said ballast for detecting a current in said ballast;

a first shunt circuit operatively coupled to said current detector for shunting a portion of said power inverter to prevent said power inverter from oscillating when said current detector detects a current having certain characteristics; and a second switching device operatively coupled to said current detector and operatively connected to said first shunt circuit such that said current detector controls said second switching device which in turn controls said first shunt circuit.

24. The arc detection and cut-out circuit of claim 23 further comprising a threshold detector operatively coupled to said current detector and said second switching device for actuating said second switching device when the output of said current detector reaches a certain threshold.

25. An arc detection and cut-out circuit for protecting an electronic ballast having a power inverter with at least one switching device, said circuit comprising:

a current detector electrically coupled to said ballast for detecting a current in said ballast;

a first shunt circuit operatively coupled to said current detector for shunting a portion of said power inverter to prevent said power inverter from oscillating when said current detector detects a current having certain characteristics; and wherein said current detector further comprises a delay circuit for delaying the output of said current detector such that the first shunt circuit does not shunt said power inverter when said current detector detects a current resulting from certain spurious signals.

26. The arc detection and cut-out circuit of claim 25 wherein the length of the delay caused by said delay circuit is proportional to the power of the current detected by said current detector.

* * * * *